US012546548B1

(12) United States Patent
Evans

(10) Patent No.: US 12,546,548 B1
(45) Date of Patent: Feb. 10, 2026

(54) CHARGING HANDLE ASSEMBLY FOR PISTOL SLIDE

(71) Applicant: Dallas Evans, Bristol, WI (US)

(72) Inventor: Dallas Evans, Bristol, WI (US)

( * ) Notice: Subject to any disclaimer, the term of this patent is extended or adjusted under 35 U.S.C. 154(b) by 0 days.

(21) Appl. No.: 18/927,607

(22) Filed: Oct. 25, 2024

(51) Int. Cl.
*F41A 3/72* (2006.01)
*F41A 3/66* (2006.01)

(52) U.S. Cl.
CPC . *F41A 3/72* (2013.01); *F41A 3/66* (2013.01)

(58) Field of Classification Search
CPC ..... F41A 3/72; F41A 3/66; F41A 35/06
See application file for complete search history.

(56) References Cited

U.S. PATENT DOCUMENTS 3,648,396 A * 3/1972 Smith ..... F41C 23/12 42/72
4,823,671 A 4/1989 Buryta
6,561,073 B1 5/2003 Høgmoe
8,015,741 B2 9/2011 Hooks
8,312,803 B2 11/2012 Oz
8,438,771 B1 * 5/2013 Boone ..... F41A 11/02 42/72
9,239,207 B2 1/2016 Kresser
9,291,413 B1 3/2016 Viani
9,500,439 B1 11/2016 Dietrich
9,523,545 B1 12/2016 Weller
9,631,893 B2 * 4/2017 Gilmer ..... F41C 23/12
9,733,043 B1 8/2017 Cohen
9,927,207 B1 * 3/2018 Haugland ..... F41C 27/00
9,995,544 B1 * 6/2018 Akimov ..... F41A 3/72
10,048,029 B2 8/2018 Larson, Jr.
10,054,380 B1 8/2018 Walters
10,054,393 B2 * 8/2018 Kedairy ..... F41C 23/12
10,161,696 B2 12/2018 Teitel
10,274,272 B1 4/2019 Owensby
10,551,142 B1 2/2020 Wright
D900,271 S * 10/2020 Faifer ..... D22/108
10,871,345 B2 12/2020 Faifer
10,948,251 B1 * 3/2021 Hopkins ..... F41C 23/10
11,156,433 B2 10/2021 Griffith
11,287,199 B1 3/2022 Cahill
11,293,707 B1 4/2022 Lee
11,441,869 B2 9/2022 Zimmer
11,460,267 B2 10/2022 Faifer
11,549,768 B1 1/2023 Pischke
11,644,273 B1 5/2023 Hughes
2009/0064556 A1 3/2009 Fluhr
2011/0083551 A1 * 4/2011 Sirochman ..... F41A 5/18 89/1.4
2011/0088539 A1 4/2011 Oz
2011/0113665 A1 5/2011 Cottle
2011/0154710 A1 6/2011 Hatfield
(Continued)

*Primary Examiner* — Joshua E Freeman

(57) ABSTRACT

In some examples, a charging handle assembly for a pistol slide includes a base including at least one connecting feature to facilitate connection of the base adjacent a lateral side of a pistol slide and a charging handle including a base portion and a lever portion, the charging handle having a length extending from a proximal end at the base portion to a distal end of the lever portion, wherein the base portion of the charging handle is connected to the base to permit the charging handle to move between a first position relative to the base and a second position relative to the base.

16 Claims, 8 Drawing Sheets

(56) References Cited

U.S. PATENT DOCUMENTS

| | | | | |
|---|---|---|---|---|
| 2011/0283582 | A1 | 11/2011 | Hunter | |
| 2011/0283587 | A1 | 11/2011 | Sharp | |
| 2012/0131829 | A1 | 5/2012 | Fistikchi | |
| 2012/0198744 | A1 | 8/2012 | Meller | |
| 2012/0291612 | A1 | 11/2012 | Kincel | |
| 2013/0061737 | A1* | 3/2013 | Brown | F41A 3/72 89/1.4 |
| 2013/0111799 | A1* | 5/2013 | Lee | F41G 11/001 42/106 |
| 2013/0185975 | A1 | 7/2013 | Johnson | |
| 2013/0255478 | A1 | 10/2013 | Mcaninch | |
| 2014/0075803 | A1 | 3/2014 | Muller | |
| 2014/0075812 | A1 | 3/2014 | Johnson | |
| 2014/0298703 | A1 | 10/2014 | Gale | |
| 2014/0360076 | A1 | 12/2014 | Zamlinsky | |
| 2015/0121734 | A1* | 5/2015 | Kresser | F41C 3/00 42/16 |
| 2015/0184959 | A1 | 7/2015 | Parnell | |
| 2015/0316346 | A1 | 11/2015 | Brandt | |
| 2015/0354909 | A1 | 12/2015 | Tarantino | |
| 2016/0102938 | A1* | 4/2016 | Sroufe | F41C 3/00 42/16 |
| 2016/0146558 | A1 | 5/2016 | Kada | |
| 2017/0131051 | A1 | 5/2017 | Albury | |
| 2017/0321977 | A1* | 11/2017 | Teitel | F41A 3/72 |
| 2018/0195819 | A1 | 7/2018 | Porat | |
| 2022/0146219 | A1* | 5/2022 | Noonan | F41A 5/30 |
| 2022/0357117 | A1 | 11/2022 | Porat | |
| 2023/0029097 | A1 | 1/2023 | Santa | |
| 2023/0132043 | A1* | 4/2023 | Porat | F41C 23/12 42/69.02 |

* cited by examiner

CHARGING HANDLE ASSEMBLY FOR PISTOL SLIDE

BACKGROUND

A pistol slide, the upper part of semi-automatic or automatic pistol that reciprocates or translates back and forth during the pistol's operating cycle, houses the firing pin or striker, an extractor to extract casings, the barrel, and provides a mounting platform for front and rear sights.

During operation, as the firing pin or striker impacts the primer at the base of a cartridge or round of ammunition, which ignites the powder or propellant, to increase the energy within the cartridge arising from the deflagration and expansion of the high-pressure gas formed to thereby separate the bullet from the cartridge and accelerate the bullet into and along the barrel. For a short recoil operation cycle, upon firing, the bolt and the barrel recoil backwards a short distance while locked together. Toward the end of the barrel travel, the bolt and the barrel unlock from one another and the barrel stops, but the unlocked bolt continues to move rearwardly, ejecting the empty shell via the ejector, and compressing the recoil spring. The bolt then returns forwardly to the initial position under the bias of the recoil spring and, during that movement, strips another round of ammunition from the top of a magazine, and pushes that round forward into position within a chamber of the barrel with the bolt locking to the barrel and forcing the barrel to return to battery with both the barrel and the bolt being fully forward.

At times, an operator of the pistol is required to manually manipulate the slide rearwardly, such as when a loaded magazine is first inserted into the grip of the pistol. If the slide is not already locked back and held in place by the slide release, such as by the expending of a last round from a prior magazine, the operator needs to pull the slide rearwardly to manually compress the recoil spring and to position the slide in a sufficiently rearward position so that forward movement of the slide and bolt forward under the bias of the recoil spring strips the top round of ammunition from the loaded magazine and pushes that round forward to chamber the round. In another manner of slide manipulation, a lesser movement of the slide rearwardly out of battery, a "press check," is performed to expose a portion of the chamber to enable visual inspection to permit the operator to determine if a round is chambered. To facilitate these manipulations, many pistol slides comprise slide serrations, vertical or angled cuts in the lateral surfaces of the slide at the front and/or the rear portions of the slide, to enhance the operator's tactile engagement with the slide.

Figure 1A:
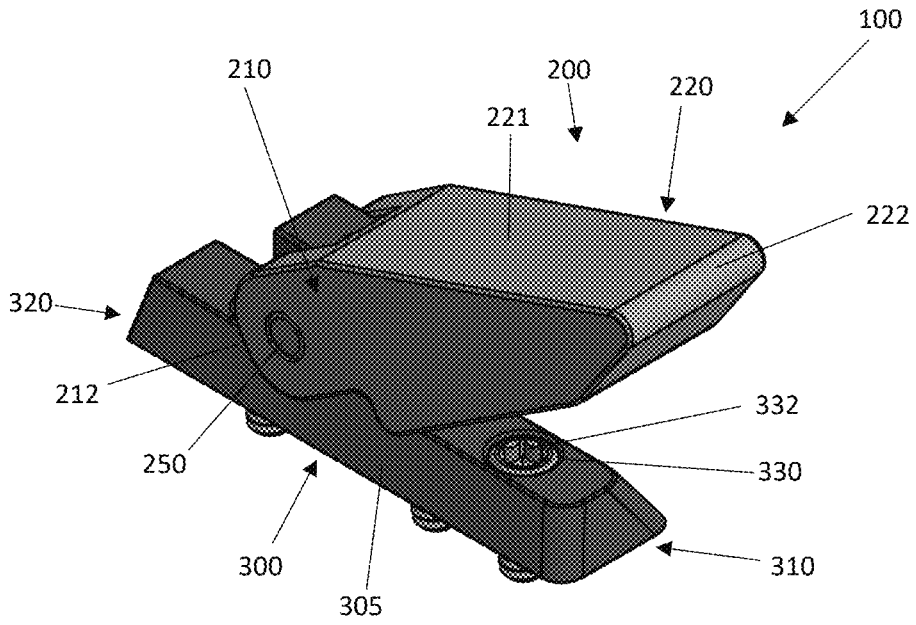
FIGS. 1A-1B are example perspective views of an example assembled charging handle assembly for a pistol slide in an example first position and an example second position, respectively, in accord with at least some of the present concepts.

The figures are not necessarily to scale. Wherever possible, the same reference numbers, or similar reference numbers, are used throughout the drawing(s) and accompanying written description to refer to the same or like parts. As used herein, stating that any part is in any way positioned on (e.g., positioned on, located on, disposed on, etc.) another part, indicates that the referenced part is either in contact with the other part, or that the referenced part is above the other part with one or more intermediate part(s) located therebetween. Stating that any part is in contact with another part means that there is no intermediate part between the two parts.

SUMMARY OF THE INVENTION

In some examples, the present concepts include a charging handle assembly for a pistol slide, comprising a base comprising at least one connecting feature to facilitate connection of the base adjacent a lateral side of a pistol slide and a charging handle comprising a base portion and a lever portion, the charging handle having a length extending from a proximal end at the base portion to a distal end of the lever portion, wherein the base portion of the charging handle is connected to the base to permit the charging handle to move between a first position relative to the base and a second position relative to the base.

In some examples, the present concepts include a semi-automatic pistol slide, comprising a first lateral side, an upper side, and a second lateral side, the slide having a length extending from a proximal end to a distal end, the second lateral side defining an ejection port comprising a proximal end at a first distance from the proximal end of the slide and comprising a distal end at a second distance from the proximal end of the slide and a charging handle assembly disposed at a portion of the first lateral side of the slide, the second lateral side of the slide, or both the first lateral side and the second lateral side of the slide, the charging handle assembly comprising a base comprising at least one connecting feature to facilitate connection of the base to the first lateral side or the second lateral side of the slide and further comprising a charging handle comprising a base portion and a lever portion, the charging handle having a length extending from a proximal end at the base portion to a distal end of the lever portion, wherein the base portion of the charging handle is connected to the base to permit the charging handle to move between a first position relative to the base and a second position relative to the base.

In some examples, the present concepts include a semi-automatic pistol, comprising a frame, a slide attached to the frame to permit the slide to translate relative to the frame, the slide defining a first lateral side, an upper side, and a second lateral side, the slide having a length extending from a proximal end to a distal end, the second lateral side defining an ejection port comprising a proximal end at a first distance from the proximal end of the slide and comprising a distal end at a second distance from the proximal end of the slide, a charging handle assembly disposed at a portion of the first lateral side of the slide, the second lateral side of the slide, or both the first lateral side and the second lateral side of the slide, the charging handle assembly comprising a base comprising at least one connecting feature to facilitate connection of the base to the first lateral side or the second lateral side of the slide and further comprising a charging handle comprising a base portion and a lever portion, the charging handle having a length extending from a proximal end at the base portion to a distal end of the lever portion, wherein the base portion of the charging handle is connected to the base to permit the charging handle to move between a first position relative to the base and a second position relative to the base, and a stabilization device attached to the frame of the semiautomatic pistol, the stabilization device comprising at least one stabilizing member extending rearwardly from the frame, wherein the charging handle assembly is disposed on the second lateral side between the distal end of the ejection portion and the distal end of the slide.

DETAILED DESCRIPTION

In some examples, the intent of the adaptable folding charging handle is to assist the shooter in rearward manipulation of a pistol slide, such as to a locked back position.

Figure 1B:
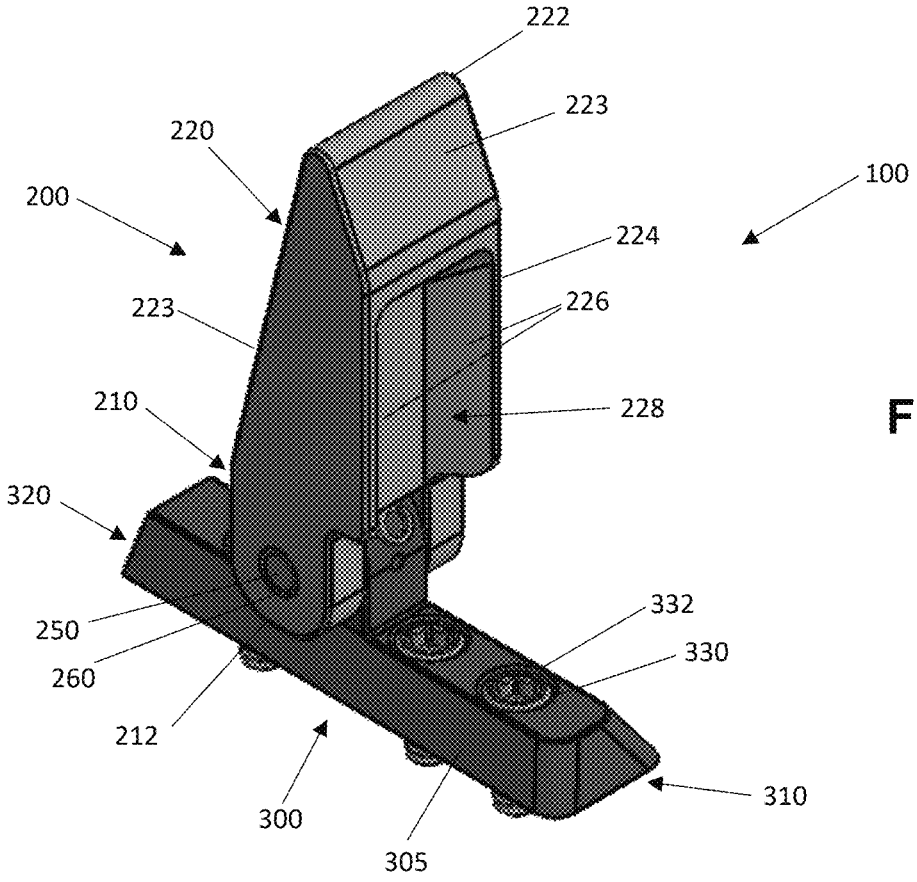

FIGS. 1A-1B are example perspective views of an example assembled charging handle assembly for a pistol slide in an example first position (e.g., a closed or stowed position) and an example second position (e.g., an open or deployed position), respectively, in accord with at least some of the present concepts.

As shown in FIGS. 1A-1B, in the example charging handle assembly 100 for a pistol slide (not shown), includes an example charging handle 200 comprising an example rear or base (proximal) portion 210 and an example front or distal lever portion 220, the example charging handle 200 having a length extending from an example proximal end 212 at the example base portion 210 to an example distal end 222 of the example lever portion 220.

Figure 4A:
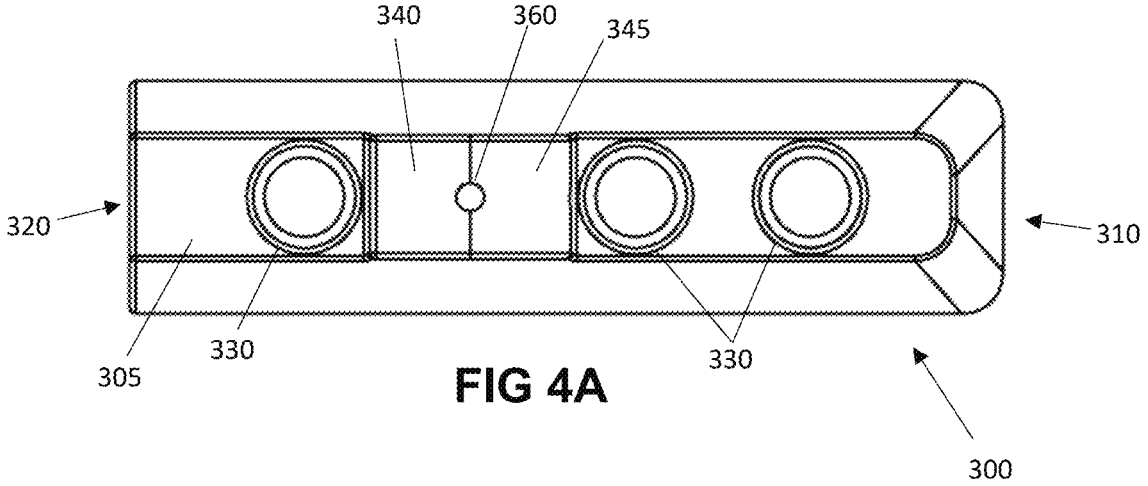
FIGS. 4A-4E are, respectively, top, side, bottom, rear and front views of the example base of the example assembled charging handle assembly of FIGS. 1A-3E.
Figure 4B:
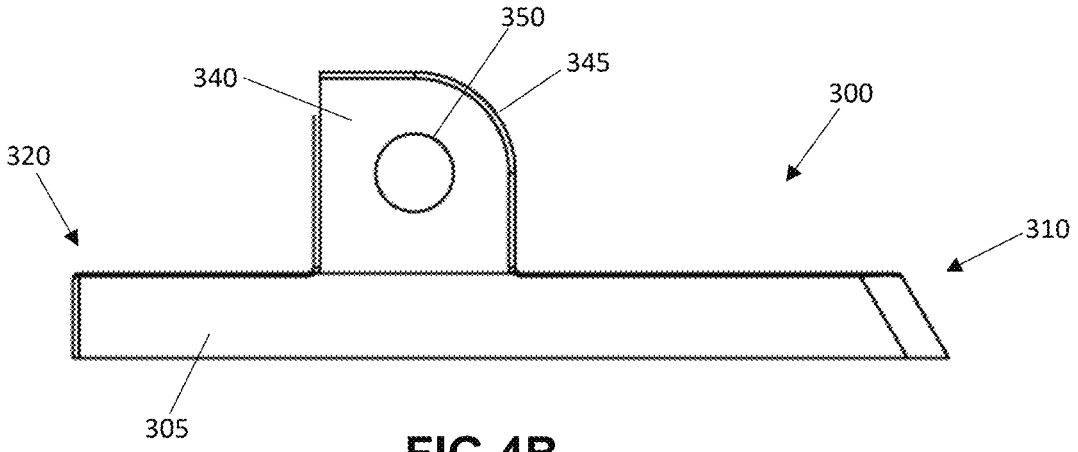
Figure 4C:
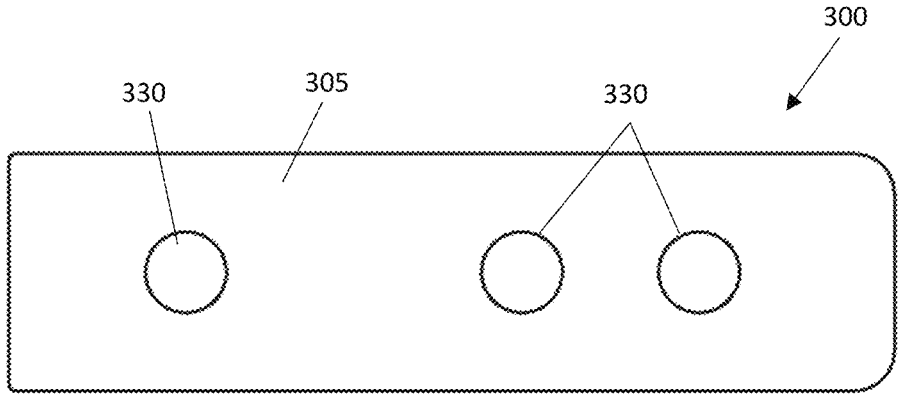
Figure 4D:
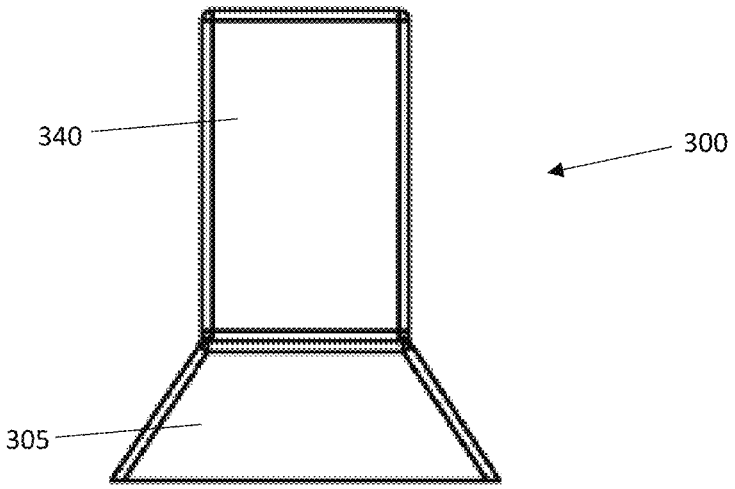
Figure 4E:
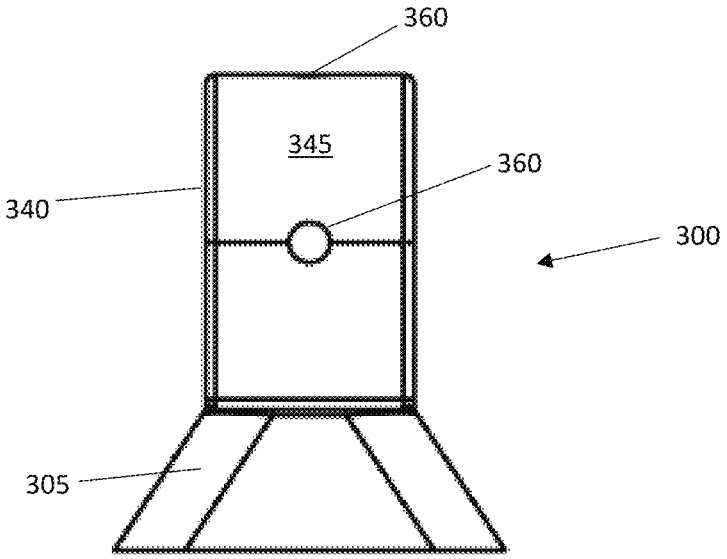
Figure 5A:
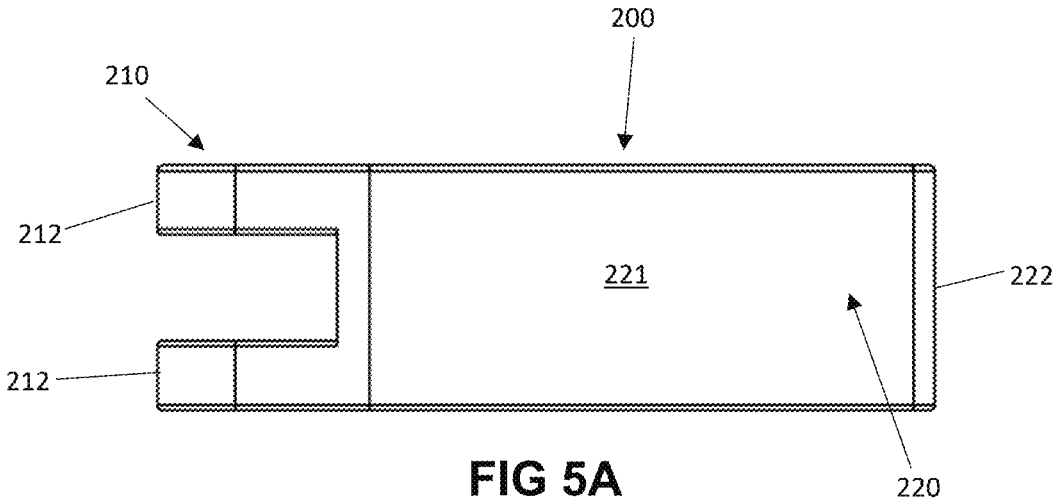
FIGS. 5A-5E are, respectively, top, side, bottom, rear and front views of the example charging handle lever of the example assembled charging handle assembly of FIGS. 1A-4E.
Figure 5B:
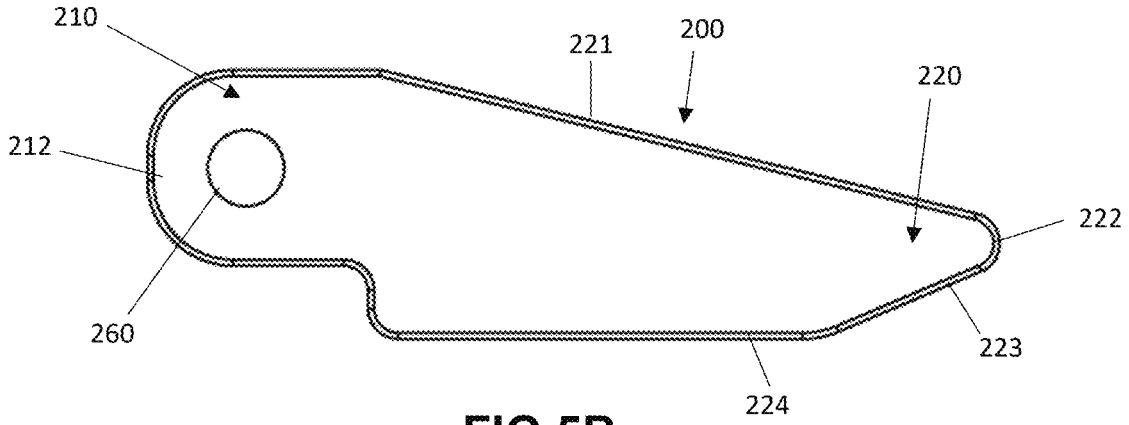
Figure 5C:
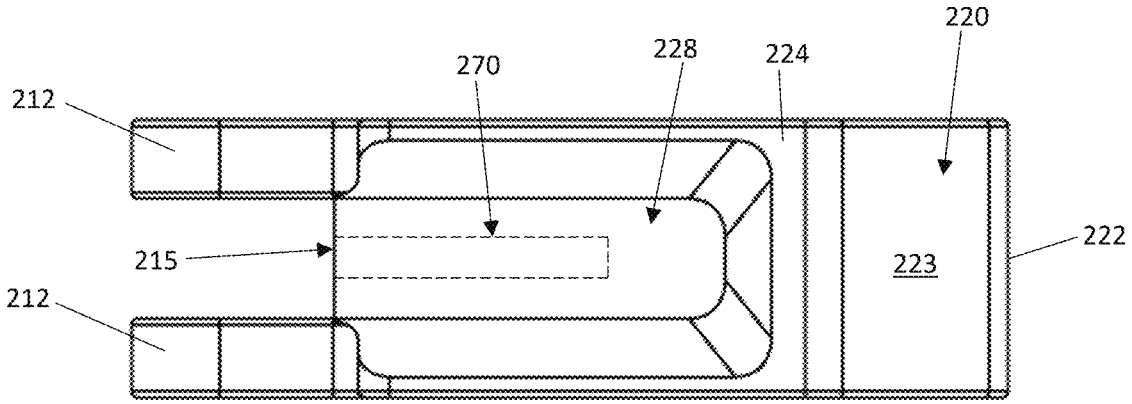
Figure 5D:
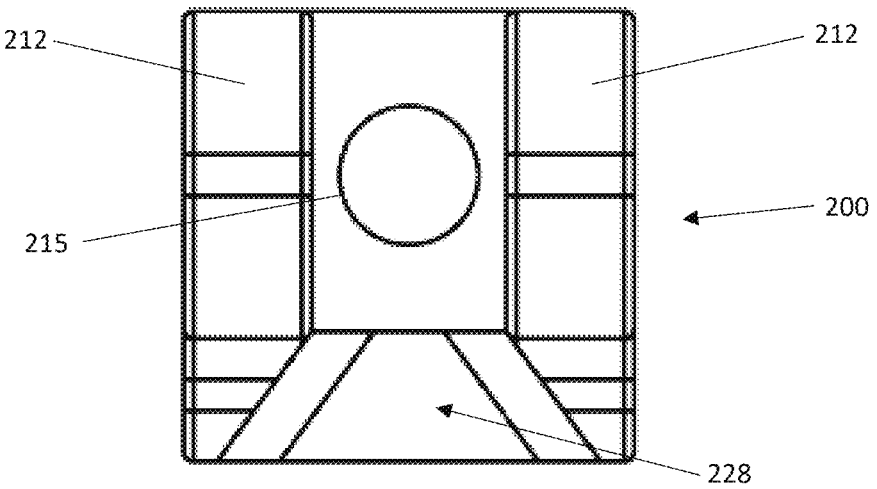
Figure 5E:
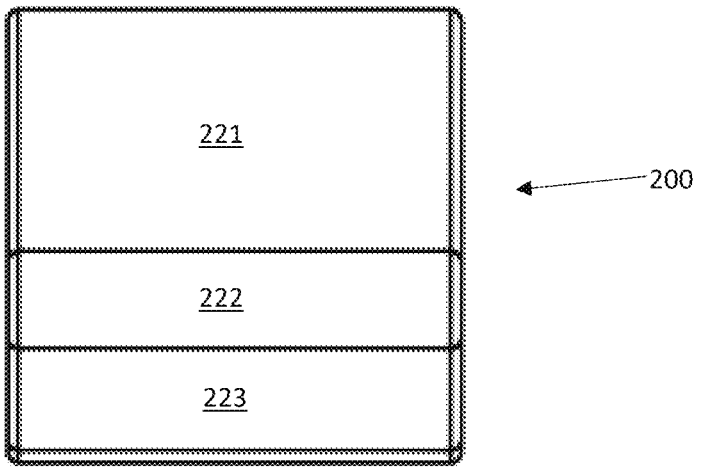

In the example of FIGS. 1A-1B, the example charging handle 200 is rotatably attached to an example base 300 of the example charging handle assembly 100. In the example of FIGS. 1A-1B, the example rotatable connection comprises a first rotatable connection member on, or forming a part of, the base portion of the charging handle. For instance, in FIGS. 1A-1B, the first rotatable connection member comprises an example shaft 250 extending through example openings 260 in the example charging handle 200 to engage a second rotatable connection member on, or forming a part of, the example base 300 (e.g., an opening in an example extending member 340 extending outwardly from the example base 300 (not shown in FIGS. 1A-1B) (see FIG. 4B)), wherein the first rotatable connection member is rotatably connected to the second rotatable connection to permit rotation of the example charging handle 200 relative to the example base 300.

FIG. 1A shows the example charging handle 200 in an intermediate (i.e., partially-open/partially-closed) position between a closed or stowed position and an open or deployed position. In another example, the first rotatable connection member could comprise a first pin extend inwardly from a first proximal end 212 portion of the example charging handle 200 and a second pin extend inwardly from a second proximal end 212 portion of the example charging handle 200, with the first and second pins rotationally engaging openings (e.g., a through hole, recesses, etc.) in the example base 300. In other examples, the first rotatable connection member comprises, rather than example shaft 250, a Chicago-type screw or a shoulder screw.

FIG. 1B shows the example charging handle 200 in an example open or deployed position. While the example open or deployed position in FIG. 1B is shown to be about a 90° angle relative to the longitudinal axis of the example base 300, the open or deployed position could be at an angle other than about 90° relative to the longitudinal axis of the example base 300 such as, but not limited to, 75°, 80°, 85°, 95°, 100°, 105°, 110°, 115°, 120°, 125°, 130°, etc., or any intermediate angle therebetween. In some examples, in the open or deployed position, an axis along the length of the charging handle forms an angle of between about 75°-115° to a longitudinal axis of the base.

Figure 3A:
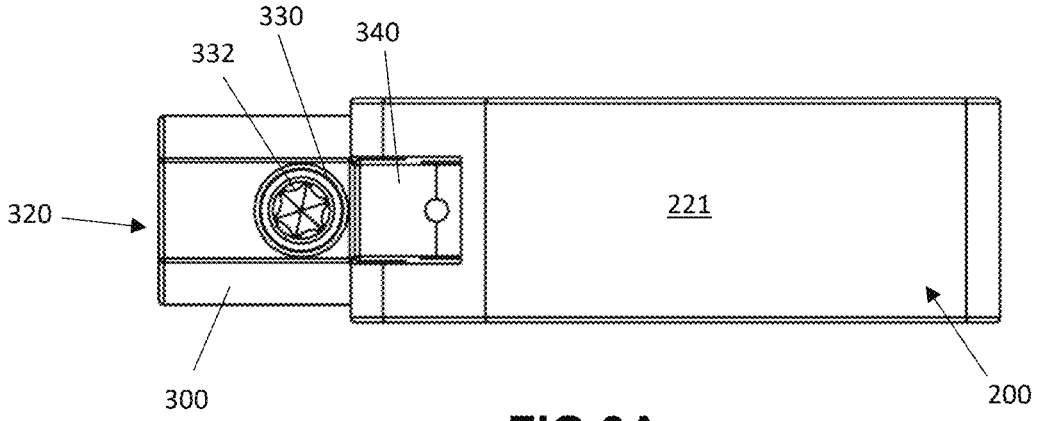
FIGS. 3A-3E are, respectively, top, side, bottom, rear and front views of the example assembled charging handle assembly of FIGS. 1A-2.
Figure 3B:
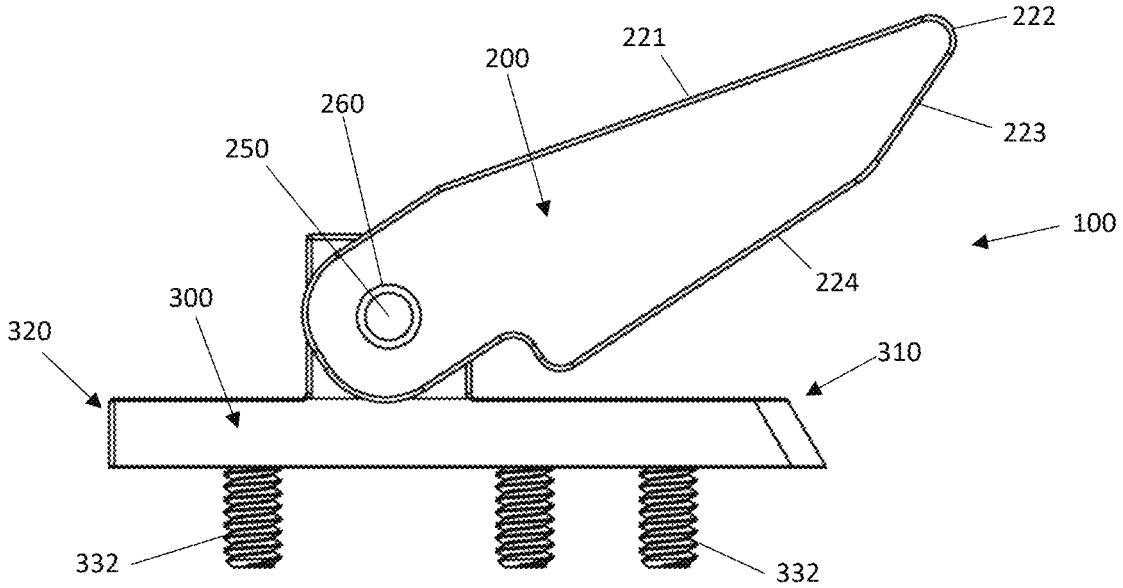
Figure 3C:
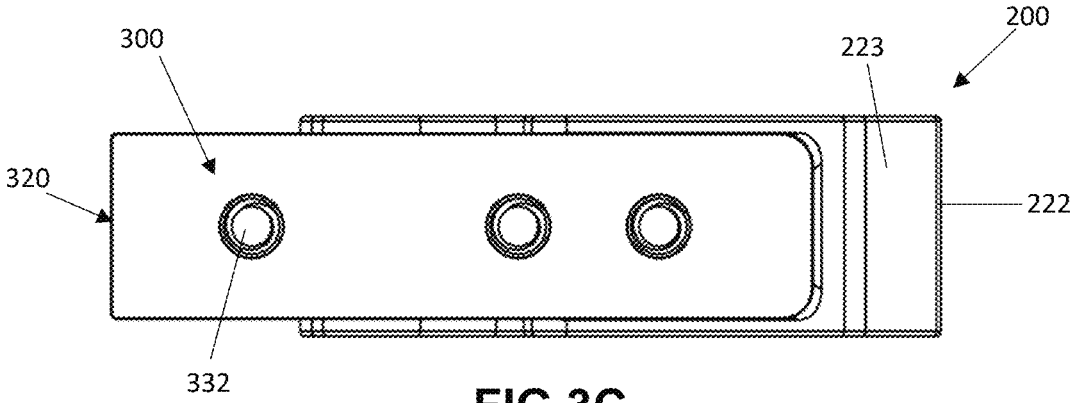
Figure 3D:
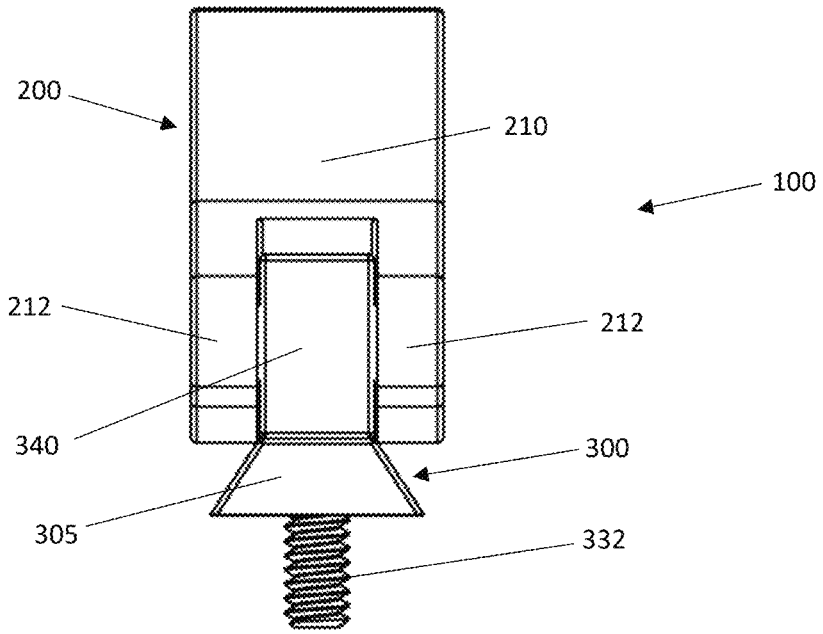
Figure 3E:
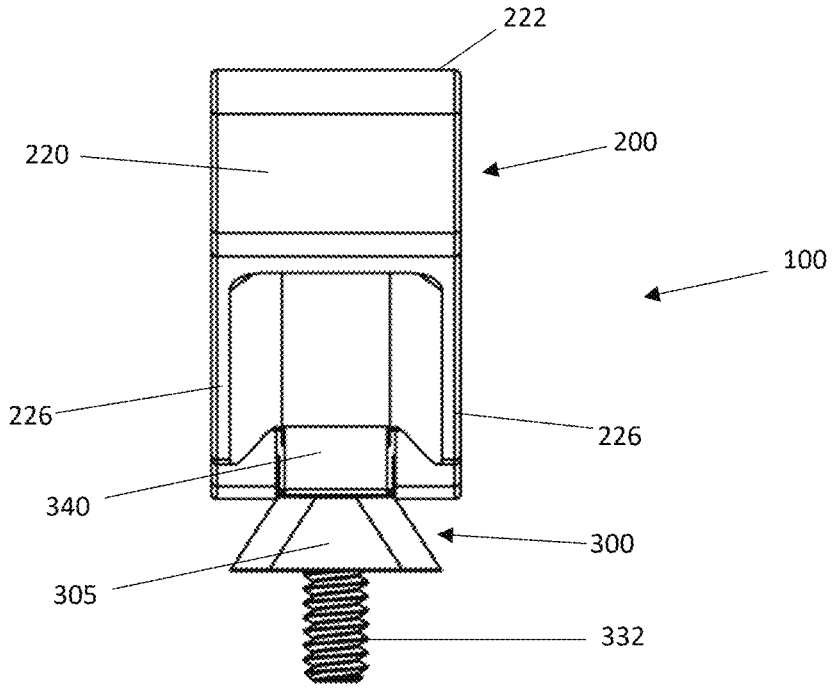

Likewise, while the example closed or stowed position (see, e.g., in FIG. 3E) is shown to be generally parallel to the longitudinal axis of the example base 300 (e.g., about 0°), the example closed or stowed position could be at an angle other than about 0° relative to the longitudinal axis of the example base 300 such as, but not limited to, −10°, −5°, 5°, 10°, etc., or any intermediate angle therebetween. In some examples, in the closed or stowed position, an axis along the length of the example charging handle 200 forms an angle of less than about 1-2° to a longitudinal axis of the example base 300.

Additionally, in at least some examples of the present concepts, the example open or deployed position and/or the example closed or stowed position could be user-selectable. For instance, the example open or deployed position and/or the example closed or stowed position could be limited by a repositioning of a first movable stop for the open or deployed position and/or a second movable stop for the closed or stowed position.

While the illustrated example herein presents an example charging handle 200 bearing a particular profile including example surfaces 221, 222 and 223 configured to facilitate a user's digital engagement and manipulation of the example charging handle 200, particularly as to an initiation of engagement while the example charging handle 200 is in a closed or stowed position, the present concepts include variations on the configuration of the example front or distal lever portion 220 of the example charging handle 200 to facilitate a user's digital engagement and manipulation at the closed position, intermediate positions and/or fully-open or deployed position of the example charging handle 200. For instance, the example distal surface 222 or distal example lower surface 223 of the example charging handle 200 could comprise one or more protruding members (e.g., a curved member, a ledge, etc.) and/or a high friction surface (e.g., checkering, knurling, high friction adhesive applique, etc.) against which a user's finger can find additional resistance and/or purchase at any of, or all of, the closed position, intermediate positions and/or fully-open or deployed position.

The example base 300 shown in FIGS. 1A-1B is shown to include an example base member 305 having a length extending along a longitudinal axis from an example rear (proximal) portion 320 to an example front or distal portion 310. The example base member 305 comprises one or more example connecting features 330 to connect the example base member 305 to a slide, or to an intermediary component attached to a slide (e.g., an adapter plate). In the example of FIGS. 1A-1B, the one or more example connecting features 330 comprise one or more through holes (e.g., three through holes in the illustrated examples) through which example mechanical fasteners 332 are disposed, with threads at distal ends of the example mechanical fasteners 332 configured to extend past a bottom surface of the example base member 305 to permit engagement with correspondingly mating threads formed in openings in a slide or formed in an adapter or intermediary component attached to a slide to secure the example charging handle assembly 100 to the slide. In some examples, the example base member 305 includes only one through hole 330 or includes two through holes 330. In some examples, the one or more example connecting features 330 comprise, either in combination with one or more example through holes, or in lieu thereof, other means by which the example base member 305 may be mechanically connected to a slide. For instance, a bottom portion of the example base member 305 could comprise a slot (e.g., a slot having a generally triangular cross section, etc.) or a protruding rail or key configured to engage (e.g., insertion into and translation along) a corresponding mating element in, or, or attached to the slide, with the respective slot and key being locked together via one or more pins or locks.

In other examples, while not a currently preferred embodiment, the example connecting features 330 are optionally omitted and the example base member 305 can be attached to a slide via welding, soldering, brazing, or via an adhesive.

In some examples, a bottom surface of the example base member 305 comprises one or more example connecting features 330 configured to engage specific geometries of and/or features of a particular slide (e.g., a specific OEM slide for a specific pistol made by a firearm manufacturer, a slide manufactured by a third-party for a specific pistol, etc.). For example, the example base member 305 could be formed with lands and grooves configured to engage one or more slide serrations of a specific slide.

In some examples, the one or more example connecting features 330 comprises a first connection feature at a proximal portion of the example base member 305 and a second connection feature at a distal portion of the example base member 305. In some examples, such as shown the connection feature, the second connection feature, or both the first connection feature and the second connection feature comprise a through hole, a counterbored through hole, or a countersunk through hole. In other examples, the connection feature, the second connection feature, or both the first connection feature and the second connection feature comprise a slot or a rail. In some examples, the one or more example connecting features 330 further comprise a first connection feature, a second connection feature and a third connection feature disposed along the example base member 305, wherein the first connection feature, the second connection feature, and the third connection feature comprise a through hole, a counterbored through hole, a countersunk through hole, a slot, a dovetail slot, a rail, a dovetail rail, in any combination.

While the example of FIGS. 1A-1B shows an example base member 305 having a substantially flat bottom surface, the bottom surface of the base member 305 could be adapted to matingly engage a geometry of a specific slide, such as a slide having a first slide surface disposed at an angle relative to an adjacent second slide surface.

As shown in FIG. 1B, an underside of a middle to distal portion of the example charging handle 200 is shown to define an example recess 228, via walls or surfaces including example sidewalls 226 on lateral sides of the example charging handle 200, configured to enable the example charging handle 200 to assume a desired profile in a closed or stowed position. For instance, as shown, the example recess 228 is configured to generally matingly engage adjacent (in the closed or stowed position) upper and lateral surfaces of the example base member 305. Stated differently, in some examples, upper surfaces and/or side surfaces of the middle to distal end of the base member 305 are shaped to cooperatively mate with lower surfaces and/or side surfaces (e.g., 226) of the example charging handle 200. In some examples, the example charging handle 200 omits the example sidewalls 226.

In some examples the example charging handle assembly 100 comprises, one or more locking members disposed on the example charging handle 200, the example base 300, or on both the example charging handle and the example base, wherein the one or more locking members are configured to releasably lock the example charging handle 200 in the first position (e.g., the stowed position), the second position (e.g., the deployed position), or both the first position and the second position, and wherein the one or more locking members are configured to unlock the charging handle from the first position, the second position, or both the first position and the second position responsive to a biasing force (e.g., digital manipulation by a user) in a direction of rotation toward the other of the first position or second position.

Figure 2:
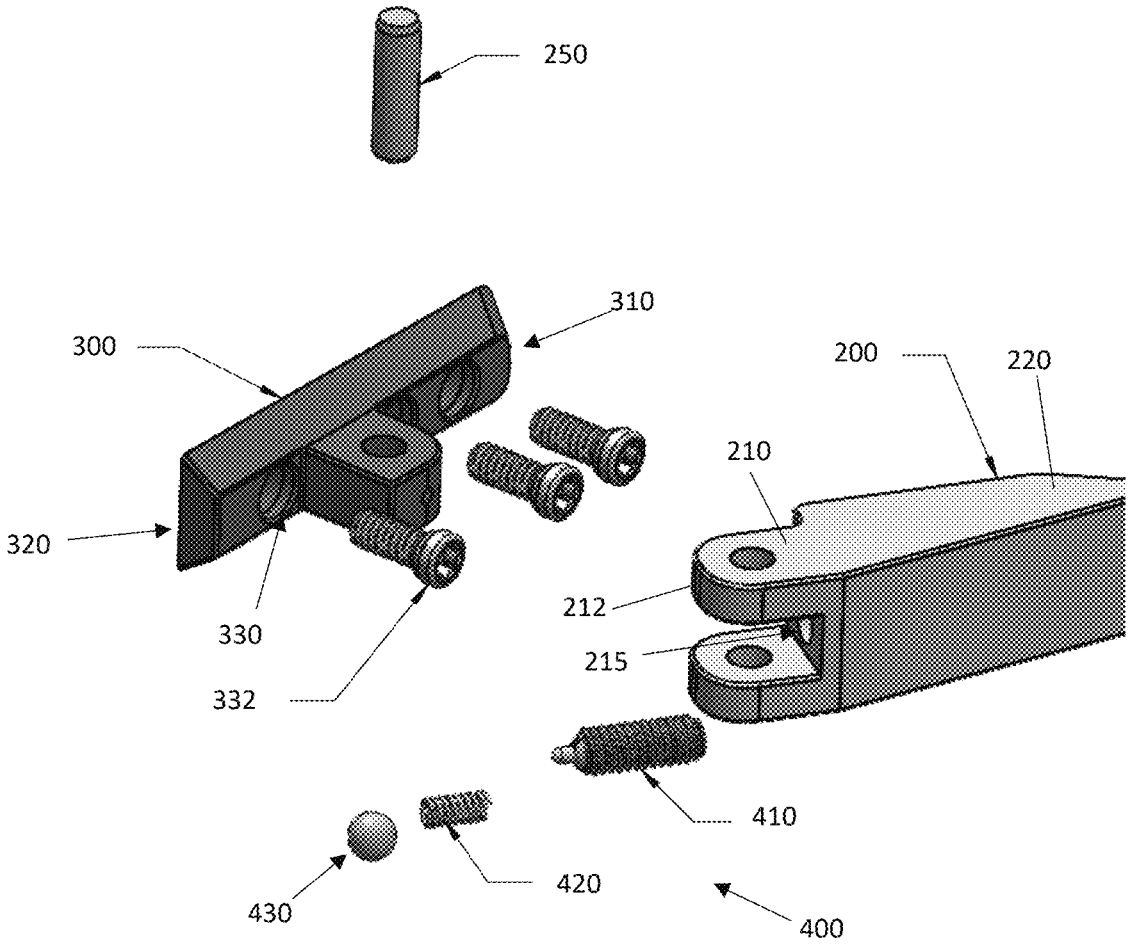
FIG. 2 is an example exploded disassembled view of the example charging handle assembly of FIGS. 1A-1B.

In some examples, the one or more locking members of the example charging handle assembly 100 comprises, as shown in FIG. 2, an example ball detent system 400 disposed within or attached to a first structure of the example charging handle 200, such as being disposed at least partially within a recess or cavity 270 (see FIG. 5C) in the example charging handle 200, so that a ball 430 of the example ball detent system 400 is biased, via a resilient member 420 (e.g., a spring, etc.) against a second structure of the example charging handle assembly 100, such as the example base 300. In the example of FIGS. 1A-5C, the second structure against which the ball 430 acts comprises a curved surface 345 of the example extending member 340 of the example base 300 (see FIG. 4B)).

In some examples, such as shown in the example of FIG. 2, the example ball detent system 400 comprises a base member 410 secured within the recess or cavity 270 against which a proximal end of the resilient member 420 acts. The example base member 410 comprises threads, which enables a user to rotate the example base member 410 clockwise or counter-clockwise to linearly move the example base member 410 into or out of the recess or cavity 270 to permit a user to adjust a degree of force imparted by the distal end of the resilient member 420 against the ball 430 and, in turn, against the example base 300. Alternatively, an example base member 410 omits threads and a user could adjust action of the resilient member 420 and ball 430 by selection of one or a plurality of available balls (e.g., of different diameter), springs (e.g., different spring constants) and/or base member (e.g., having distal surface engaging proximal end of resilient member 420 at different depths relative to the example opening 215 to the example recess or cavity 270. Optionally, the example base member 410 is omitted in favor of a recess having a bottom portion against which a proximal end of the resilient member 420 acts, directly or indirectly (e.g., one or more inserts could be disposed at the bottom portion of the example recess or cavity 270 to change a length of expansion of the resilient member 420.

More generally, the one or more locking members comprise one or more first locking members disposed on or formed on or in the charging handle 200 and one or more second locking members disposed on or formed on or in the base 300, wherein frictional engagement of one of the one or more first locking members with one of the one or more second locking members inhibits rotational motion of the charging handle relative to the base. Optionally, one or more limiters or stops are disposed on the charging handle, the base, or on both the charging handle and the base, such one or more limiters or stops being configured to limit rotational movement of the charging handle relative to the base in at least one direction of rotation of the charging handle.

As shown in FIGS. 1B, 2, 3A and 4A, the one or more locking members and/or the one or more limited members comprises example detents or recesses 360 formed in the example curved surface 345 of the example extending member 340 of the example base 300 at one or more locations along a path followed by the ball 430 of the example ball detent system 400 (e.g., at a 0° position (see, e.g., FIG. 1B) and at a 90° position (see, e.g., FIGS. 2, 3A)) so that the ball is biased into the example detents or recesses 360 to provide additional resistance to continued motion of the ball 430 along the path in a direction of movement.

In some examples, the example charging handle 200 of the example charging handle assembly 100 may be configured with a spring to facilitate or assist opening of the example charging handle 200 via a resilient element (e.g., a spring, a torsion spring, a compression spring, etc.) from a predefined initial position, such as a stowed position or an intermediate position between the stowed position and the fully open or deployed position. In some examples, the assistance may be a low level of assistance, in terms of either torque provided and/or a degree of rotation, sufficient to help overcome an optional initial resistance to movement of the example charging handle 200 from a stowed position. In some examples, the assistance may be a high level of assistance, in terms of either torque provided and/or a degree of rotation, such as to move the example charging handle 200 automatically from a stowed position to a deployed position or to move the example charging handle 200 automatically from an intermediate position (e.g., between 1-5° from the stowed position) to a deployed position (e.g., 90°). In some examples, such example charging handle assembly 100 may comprise a button, mechanism, or lever configured to actuate the resilient element to automatically deploy the example charging handle 200 from the initial position (e.g., stowed position) to the fully open or deployed position. It is to be emphasized that, particularly in aspects of the present concepts utilizing an automatic deployment in whole (i.e., full deployment) or in part (i.e., movement of the example charging handle 200 from the initial position to an intermediate position), the surfaces (e.g., surface 223) provided in the example charging handle 200 to facilitate digital manipulation, inclusive of engagement of example charging handle 200 in the stowed position, may be advantageously modified (e.g., shaped differently, minimized, etc.) to facilitate the different operational mode(s) and engagement of the example charging handle 200 by the operator at different positions relative to the slide.

FIGS. 3A-3E are, respectively, top, side, bottom, rear and front views of the example assembled charging handle assembly 100 of FIGS. 1A-2 depicted in an intermediate position (between an open position and a closed position), the constituent parts of which being described above. FIGS. 4A-4E are, respectively, top, side, bottom, rear and front views of the example base 300 of the example assembled charging handle assembly 100 of FIGS. 1A-3E and FIGS. 5A-5E are, respectively, top, side, bottom, rear and front views of the example charging handle lever 200 of the example assembled charging handle assembly 100 of FIGS. 1A-3E.

The constituent parts of the example charging handle assembly 100 are, in at least some aspects, formed from aluminum, aluminum alloys, steel, titanium or other metal alloys via conventional forming processes including, but not limited to, machining, 3-D printing, forging or casting.

In view of the above, the present concepts further include a charging handle assembly 100, as described herein, attached to a semiautomatic pistol slide, the semiautomatic pistol slide comprising a first lateral side, an upper side (e.g., a side on which the front and rear sights, or a sight, are disposed), and a second lateral side, the slide having a length extending from a proximal end (i.e., a rear end of the slide that is closest to a user during use) to a distal end (e.g., a front or muzzle end), the second lateral side, typically a right side of the slide, defining an ejection port comprising a proximal end at a first distance from the proximal end of the slide and comprising a distal end at a second distance from the proximal end of the slide.

In various examples, the charging handle assembly 100 is disposed at a portion of the first lateral side of the slide, the second lateral side of the slide, or both the first lateral side and the second lateral side of the slide, with the charging handle assembly 100 comprising a base 300 comprising at least one connecting feature 330 to facilitate connection of the base 300 to the first lateral side or the second lateral side of the slide and further comprising a charging handle 200 comprising a base portion 210 and a lever portion 220, the charging handle having a length extending from a proximal end 212 at the base portion 210 to a distal end 222 of the lever portion 220, wherein the base portion 210 of the charging handle 200 is connected to the base 300 to permit the charging handle 200 to move between a first position relative to the base and a second position relative to the base.

In view of the above, the present concepts further include a semiautomatic pistol comprising the charging handle assembly 100 and/or semiautomatic pistol slide comprising the charging handle assembly 100, as described above, wherein the semiautomatic pistol slide comprising the charging handle assembly 100 is provided with, or attached to, a pistol frame (not shown) comprising a lower receiver (i.e., a "firearm") or a grip frame. For instance, in some examples, the slide is attached to the frame to permit the slide to translate relative to the frame (i.e., forwardly and backwardly).

The present concepts further include a semiautomatic pistol comprising the charging handle assembly 100 and/or semiautomatic pistol slide comprising the charging handle assembly 100, as described above, wherein the semiautomatic pistol slide comprising the charging handle assembly 100 is provided with, or attached to, a pistol frame (not shown) comprising a lower receiver (i.e., a "firearm") or a grip frame.

The present concepts further include a semiautomatic pistol comprising the charging handle assembly 100, as described above, provided with, or attached to, a pistol frame (not shown) comprising a lower receiver (i.e., a "firearm") or grip frame, the semiautomatic pistol further comprising a stabilization device (not shown) attached to the frame of the semiautomatic pistol, the stabilization device comprising at least one stabilizing member extending rearwardly from the frame and/or extending laterally along at least a portion of the lower receiver or grip frame and/or extending laterally along and spaced apart from at least a portion of the lower receiver or grip frame and/or a lower portion of the slide, wherein the charging handle assembly 100 is disposed on the second lateral side between the distal end of the ejection portion and the distal end of the slide. For instance, the stabilization device may comprise, by way of example and without limitation, a Sig Sauer semiautomatic pistol (e.g., a Sig Sauer P320) equipped with a Flux Raider X P320 or a Sig Sauer P365 equipped with a Flux Raider P365, each Flux Raider being manufactured by Flux Defense of South Salt Lake, Utah. In accord with the present concepts, the disclosed charging handle assembly 100 advantageously facilitates an operator's manipulation of the slide, via the charging handle assembly 100, despite potential impediments to an operator's access to one or more surfaces of the slide attributable to one or more components of the stabilization device, or one or more components of another manner of attachment to a lower receiver or grip module, disposed adjacent at least a portion of the lower receiver or grip frame and/or slide.

What is claimed:

1. A charging handle assembly for a pistol slide, comprising:

a base having a first surface and a second surface opposing and spaced apart from the first surface, the base comprising at least one connecting feature to facilitate connection of the first surface of the base adjacent to a single lateral side of a pistol slide;

a charging handle comprising a base portion and a lever portion, the charging handle having a length extending from a proximal end at the base portion to a distal end of the lever portion;

a first rotatable connection member on, or forming a part of, the base portion of the charging handle; and a second rotatable connection member on, or forming a part of, the second surface of the base, wherein the first rotatable connection member of the base portion of the charging handle is rotatably connected to the second rotatable connection member of the base to permit the charging handle to rotate between a first position relative to the second surface of the base and a second position relative to the second surface of the base wherein, in the second position, an axis along the length of the charging handle forms an angle within about 15° to a normal direction of the second surface of the base.

2. The charging handle assembly according to claim 1, wherein the first position is a stowed position and a second position is a deployed position.

3. The charging handle assembly according to claim 1, wherein, in the first position, an axis along the length of the charging handle is substantially parallel to the second surface of the base and forms an angle of less than about 1-2° relative to the second surface of the base.

4. The charging handle assembly according to claim 1, wherein the at least one connecting feature comprises a plurality of connecting features.

5. The charging handle assembly according to claim 4, wherein the base defines a longitudinally extending member, wherein the plurality of connecting features comprises a first connection feature at a proximal portion of the base and a second connection feature at a distal portion of the base, and wherein the first connection feature, the second connection feature, or both the first connection feature and the second connection feature comprise a through hole, a counterbored through hole, a countersunk through hole, a slot, or a rail.

6. The charging handle assembly according to claim 5, wherein the plurality of connecting features comprises further comprises a third connection feature, and wherein the first connection feature, the second connection feature, the third connection feature, or any combination of the first connection feature, the second connection feature, and the third connection feature comprise a through hole, a counterbored through hole, a countersunk through hole, a slot, or a rail.

7. The charging handle assembly according to claim 4, wherein upper surfaces of the distal end of the longitudinally extending member are shaped to cooperatively mate with lower surfaces of the lever portion of the charging handle.

8. The charging handle assembly according to claim 4, further comprising:

one or more limiters disposed on the charging handle, the base, or on both the charging handle and the base, wherein the one or more limiters are configured to limit rotational movement of the charging handle relative to the base in one or more directions of rotation.

9. A charging handle assembly for a pistol slide, comprising:

a base comprising at least one connecting feature to facilitate connection of the base adjacent a lateral side of a pistol slide;

a charging handle comprising a base portion and a lever portion, the charging handle having a length extending from a proximal end at the base portion to a distal end of the lever portion;

a first rotatable connection member on, or forming a part of, the base portion of the charging handle; and a second rotatable connection member on, or forming a part of, the base; and one or more locking members disposed on the charging handle, the base, or on both the charging handle and the base, wherein the base portion of the charging handle is connected to the base to permit the charging handle to move between a first position relative to the base and a second position relative to the base, wherein the first rotatable connection member is rotatably connected to the second rotatable connection to permit rotation of the charging handle relative to the base, wherein the charging handle is rotatably connected to the base to rotate between the first position and the second position, wherein the at least one connecting feature comprises a plurality of connecting features, wherein the one or more locking members are configured to releasably lock the charging handle in the first position, the second position, or both the first position and the second position, and wherein the one or more locking members are configured to unlock the charging handle from the first position, the second position, or both the first position and the second position responsive to a biasing force in a direction of rotation toward the other of the first position or second position.

10. The charging handle assembly according to claim 9, wherein the one or more locking members comprises a ball detent disposed on the charging handle or the base so that a ball of the ball detent is biased, via a resilient member, against the other of the charging handle or the base.

11. The charging handle assembly according to claim 9, wherein the one or more locking members comprise one or more first locking members disposed on or formed on or in the charging handle and one or more second locking members disposed on or formed on or in the base, and wherein frictional engagement of one of the one or more first locking members with one of the one or more second locking members inhibits rotational motion of the charging handle relative to the base.

12. A semiautomatic pistol slide, comprising:

a first lateral side, an upper side, and a second lateral side, the slide having a length extending from a proximal end to a distal end, the second lateral side defining an ejection port comprising a proximal end at a first distance from the proximal end of the slide and comprising a distal end at a second distance from the proximal end of the slide; and a charging handle assembly disposed at a portion of only the first lateral side of the slide or only the second lateral side of the slide, the charging handle assembly comprising a base having a first surface and a second surface opposing and spaced apart from the first surface, the base including at least one connecting feature connecting the first surface of the base to the selected portion of only the first lateral side of the slide or only the second lateral side of the slide, the charging handle assembly further comprising a charging handle comprising a base portion and a lever portion, the charging handle having a length extending from a proximal end at the base portion to a distal end of the lever portion, a first rotatable connection member on, or forming a part of, the base portion of the charging handle, and a second rotatable connection member on, or forming a part of, the second surface of the base, wherein the first rotatable connection member of the base portion of the charging handle is rotatably connected to the second rotatable connection member of the base to permit the charging handle to rotate between a first position relative to the second surface of the base and a second position relative to the second surface of the base wherein, in the second position, an axis along the length of the charging handle forms an angle within about 15° to a normal direction of the second surface of the base.

13. The semiautomatic pistol slide according to claim 12, wherein the first position corresponds to a stowed position and the second position, corresponds to a deployed position.

14. The semiautomatic pistol slide according to claim 13, wherein the charging handle assembly comprises a locking mechanism to releasably lock the charging handle in the first position, the second position, or both first position and the second position.

15. The semiautomatic pistol slide according to claim 13, wherein the charging handle assembly is disposed on only the second lateral side of the slide between the distal end of the ejection portion and the distal end of the slide, or wherein the charging handle assembly is disposed on only the first lateral side of the slide between the first distance from the proximal end of the slide and the distal end of the slide.

16. The semiautomatic pistol slide according to claim 13, wherein the at least one connecting feature comprises a plurality of connecting features.

* * * * *